US009320090B2

(12) United States Patent
Moore et al.

(10) Patent No.: US 9,320,090 B2
(45) Date of Patent: Apr. 19, 2016

(54) LED OUTPUT RESPONSE DAMPENING FOR IRRADIANCE STEP RESPONSE OUTPUT

(71) Applicant: Phoseon Technology, Inc., Hillsboro, OR (US)

(72) Inventors: Ognyan Moore, Portland, OR (US); Paul Eddy, Portland, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 18 days.

(21) Appl. No.: 14/309,761

(22) Filed: Jun. 19, 2014

(65) Prior Publication Data

US 2015/0373791 A1 Dec. 24, 2015

(51) Int. Cl.
*G05F 1/00* (2006.01)
*H05B 33/08* (2006.01)

(52) U.S. Cl.
CPC ..... *H05B 33/0809* (2013.01); *H05B 33/0845* (2013.01)

(58) Field of Classification Search
USPC ..... 315/185 R, 192, 224, 291, 297, 300, 315/299, 302, 307, 308, 311, 362
See application file for complete search history.

(56) References Cited

U.S. PATENT DOCUMENTS

2011/0156593 A1 6/2011 De Greef et al.
2012/0229046 A1 9/2012 Melanson
2013/0009550 A1 1/2013 Ko et al.
2013/0088171 A1 4/2013 Fensore
2013/0257313 A1* 10/2013 Battaglia ..... H05B 37/02 315/297

FOREIGN PATENT DOCUMENTS

WO 2014088947 A1 6/2014

OTHER PUBLICATIONS

ISA Korean Intellectual Property Office, International Search Report and Written Opinion Issued in Application No. PCT/US2015/035869, Sep. 18, 2015, WIPO, 15 pages.

* cited by examiner

*Primary Examiner* — Douglas W Owens
*Assistant Examiner* — Jianzi Chen
(74) *Attorney, Agent, or Firm* — Alleman Hall McCoy Russell & Tuttle LLP

(57) ABSTRACT

A system and method for operating one or more light emitting devices is disclosed. In one example, the intensity of light provided by the one or more light emitting devices is adjusted responsive to follow a step change in requested lighting output.

18 Claims, 5 Drawing Sheets

LED OUTPUT RESPONSE DAMPENING FOR IRRADIANCE STEP RESPONSE OUTPUT

FIELD

The present description relates to systems and methods for improving the irradiance and/or illuminance response of light-emitting diodes (LEDs). The methods and system may be particularly useful for lighting arrays that are commanded to output in a step-wise manner.

BACKGROUND/SUMMARY

Solid-state lighting devices have many uses in residential and commercial applications. Some types of solid-state lighting devices may include laser diodes and light-emitting diodes (LEDs). Ultraviolet (UV) solid-state lighting devices may be used to curing photo sensitive media such as coatings, including inks, adhesives, preservatives, etc. The curing time of photo sensitive media may be sensitive to the intensity of light directed at the photo sensitive media and/or the amount of time that the photo sensitive media is exposed to light from the solid-state lighting device. However, output of solid-state lighting devices may vary with device junction temperatures and other conditions such that it may be difficult to provide uniform output during the curing process. Consequently, it may be desirable to provide more consistent and uniform output from the lighting devices so that work piece curing time may be more precisely controlled.

The inventors herein have recognized the above-mentioned disadvantages and have developed a method for operating one or more light emitting devices, comprising: in response to a step change in requested output of the one or more light emitting devices, adjusting current supplied to the one or more light emitting devices responsive to one or more parameters based on output of the one or more light emitting devices when a step change in voltage or current is applied to the one or more light emitting devices, the step change in voltage or current not occurring at a same time as the step change in the requested output of the one or more light emitting devices.

By controlling current flow through a lighting array based on response of the lighting array when a step current or voltage is applied to the lighting array, it may be possible to more precisely follow a step request in lighting array output. Consequently, a more uniform output from the lighting array may be output during operation of the lighting array. For example, output of a lighting array may be more intense when the lighting array is initially activated in response to activating the lighting array. However, as time goes on after initial activation, output from the lighting array may decay and converge to a desired lighting array output. Parameters such as percent of irradiance overshoot initially relative to steady state irradiance output and time for the lighting array to reach half way to the steady state temperature light output when the lighting array is activated via a step change in voltage or current applied to the lighting array may be a basis for controlling current flow into the lighting array such that output of the lighting array (e.g., irradiance) approaches a step change in desired lighting array output. Thus, an unregulated response of a lighting array may be a basis for regulating output of a lighting array.

The present description may provide several advantages. Specifically, the approach may improve lighting system output consistency. Additionally, the approach may be provided without attempting to feedback lighting system output, thereby simplifying lighting array current control. Further still, the approach may be provided to both step increases and decreases in requested lighting system output.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
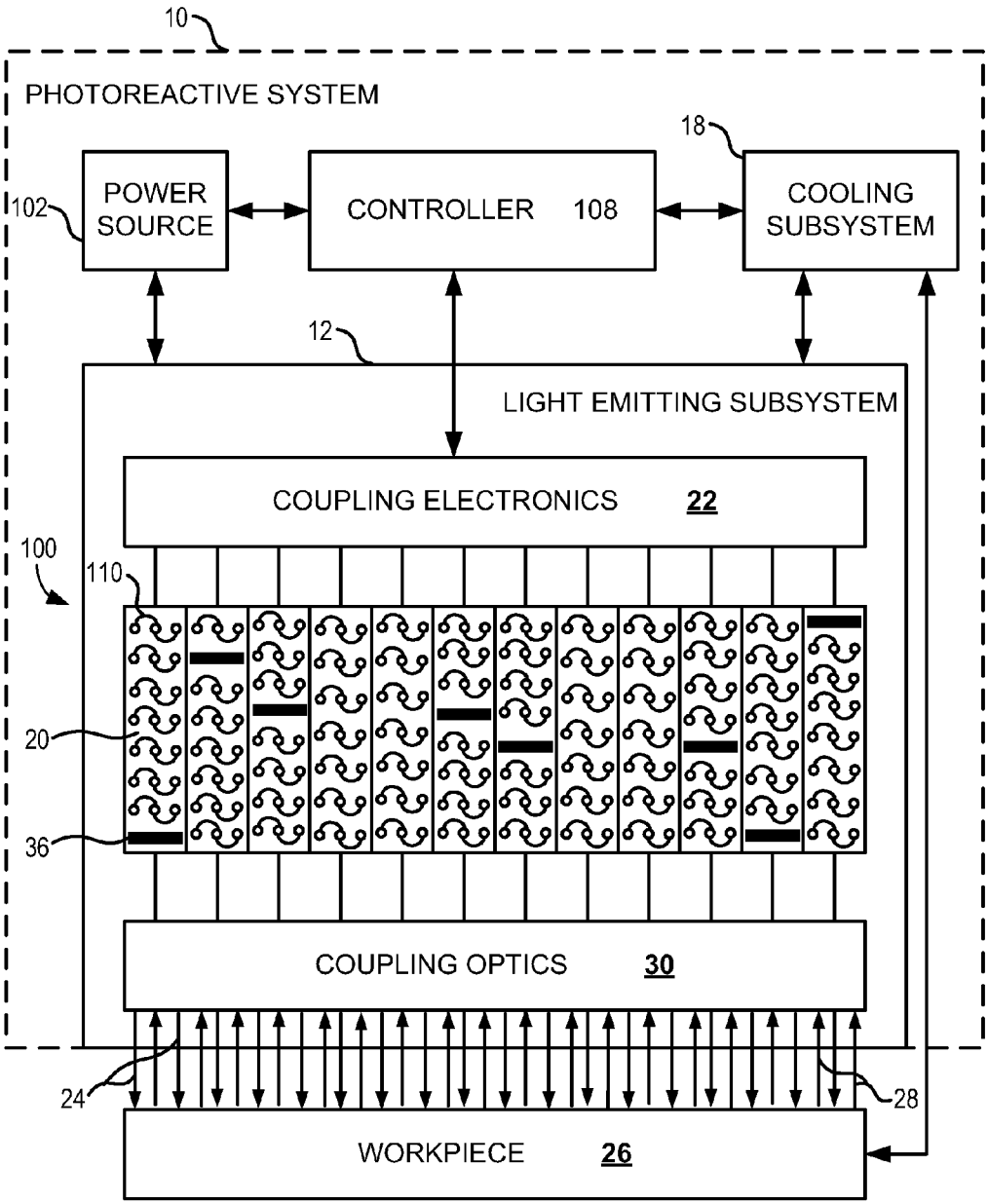
FIG. 1 shows a schematic depiction of a lighting system.
Figure 2:
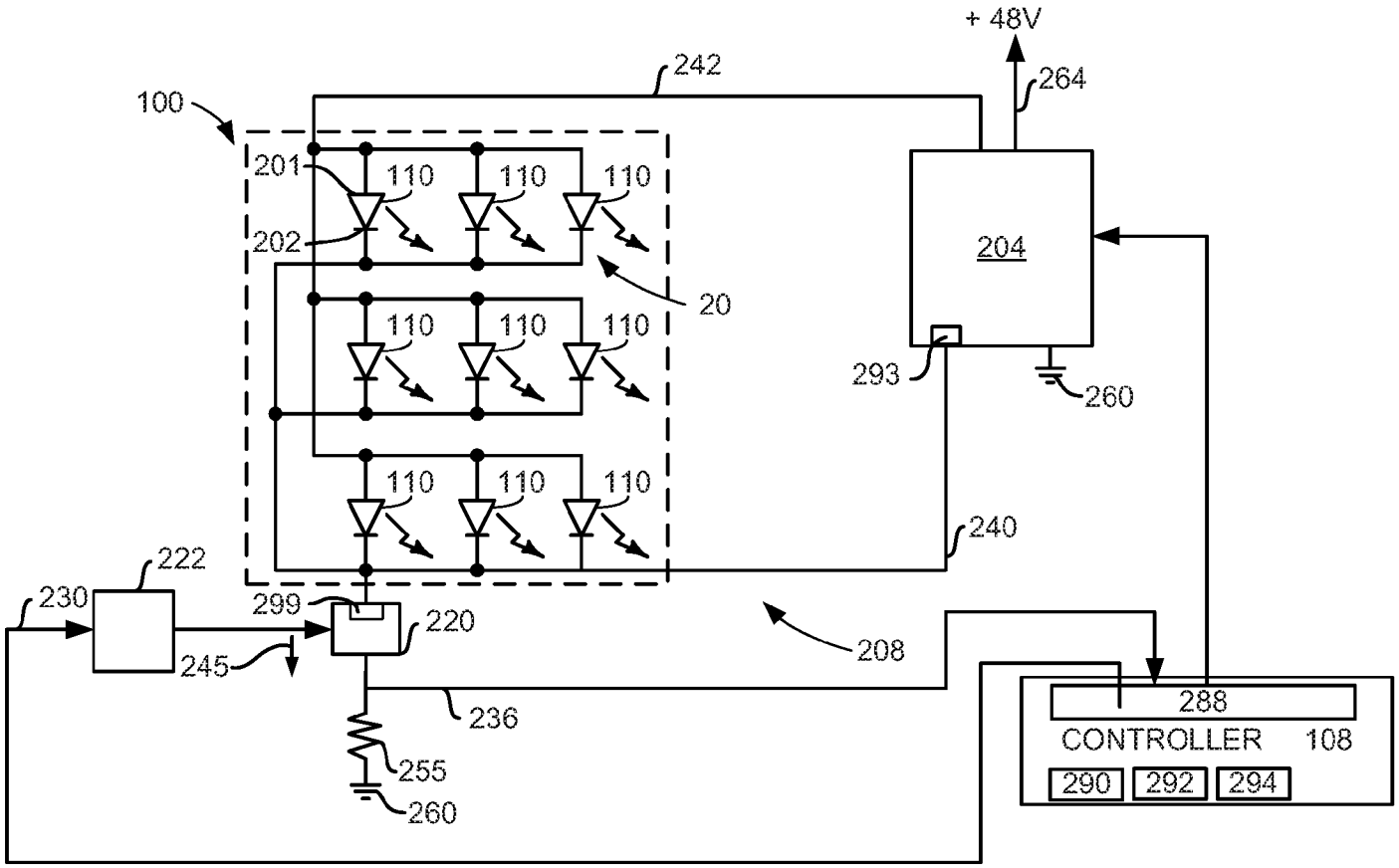
FIGS. 2-3 show schematics of example current regulating systems for the lighting system in FIG. 1.
Figure 3:
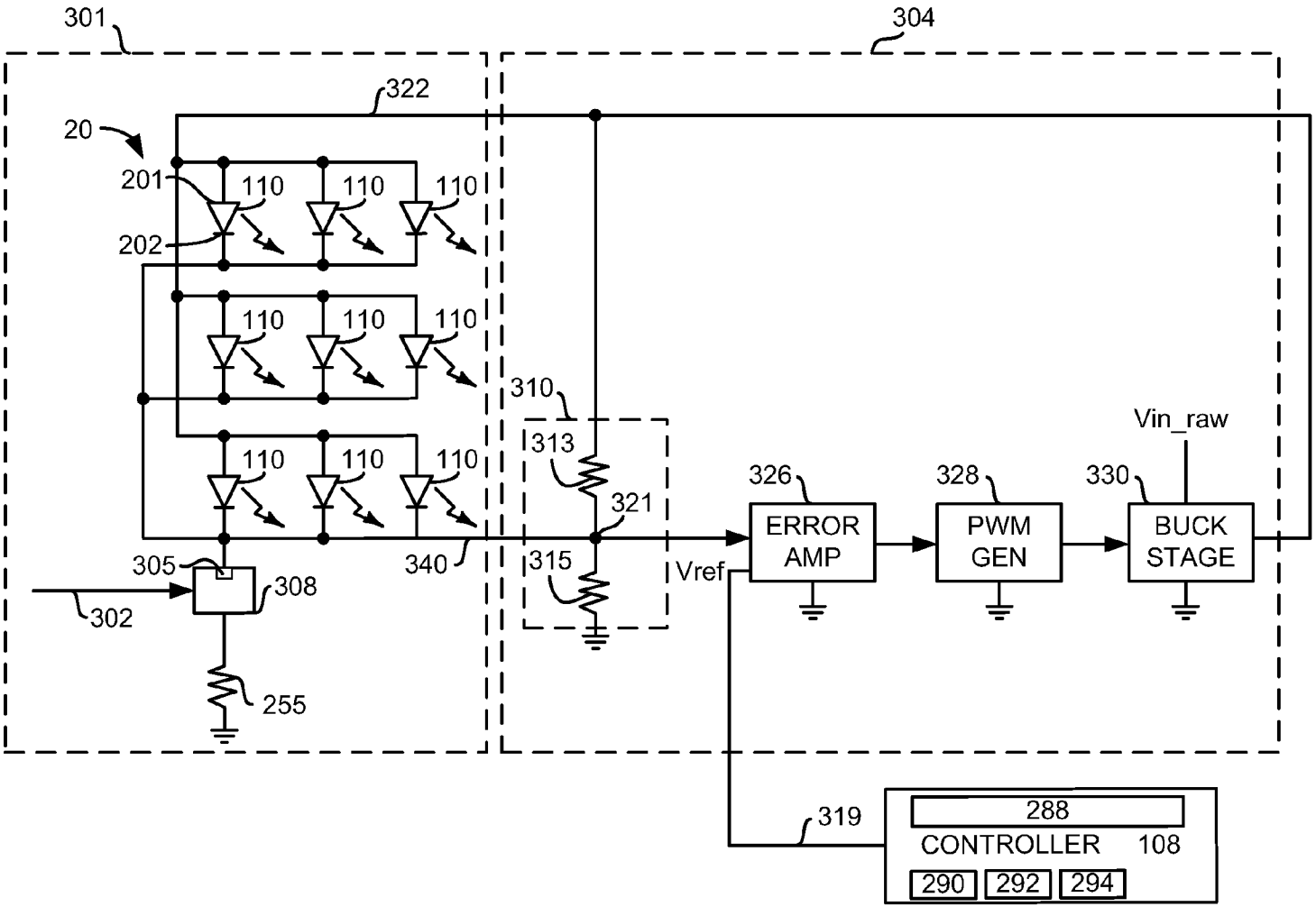
Figure 4:
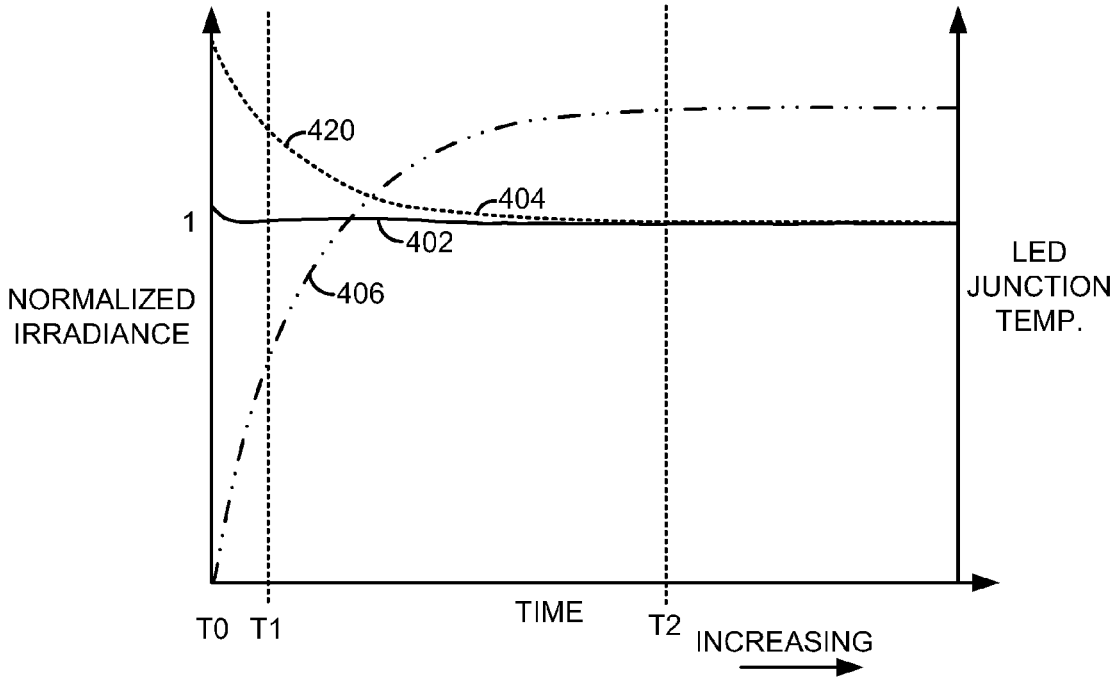
FIG. 4 shows a plot of an example simulated response of the lighting system shown in FIGS. 1-3.

The present description is related to a lighting system with a plurality of electrical current output amounts. FIG. 1 shows one example lighting system in which regulated variable current control is provided. The lighting current control may be provided according to example circuits as shown in FIGS. 2-3. The current control described herein may provide a lighting response as shown in FIG. 4. The lighting system may be operated according to the method of FIG. 5. Electrical interconnections shown between components in the various electrical diagrams represent current paths between the illustrate devices.

Referring now to FIG. 1, a block diagram of a photoreactive system 10 in accordance with the system and method described herein is shown. In this example, the photoreactive system 10 comprises a lighting subsystem 100, a controller 108, a power source 102 and a cooling subsystem 18.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, e.g., via the coupling electronics 22.

The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting subsystem 100 may be of various types. As an example, the data may be representative of one or more characteristics associated with coupled semiconductor devices 110, respectively. As another example, the data may be representative of one or more characteristics associated with the respective component 12, 102, 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting subsystem 100 (including one or more such coupled semiconductor devices). As an example, responsive to data from the lighting subsystem indicating that the light energy is insufficient at one or more points associated with the work piece, the controller 108 may be implemented to either (a) increase the power source's supply of current and/or voltage to one or more of the semiconductor devices 110, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., LED devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in an undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (e.g., by controlling a component through control signals directed to the component, based on data respecting that components operation) or indirectly (e.g., by controlling a component's operation through control signals directed to adjust operation of other components). As an example, a semiconductor device's radiant output may be adjusted indirectly through control signals directed to the power source 102 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of arrays. The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

Referring to FIG. 2, a schematic of a first lighting system circuit that may supply varying amounts of current is shown. Lighting system 100 includes one or more light emitting devices 110. In this example, light emitting devices 110 are light emitting diodes (LEDs). Each LED 110 includes an anode 201 and a cathode 202. Switching power source 102 shown in FIG. 1 supplies 48V DC power to voltage regulator 204 via path or conductor 264. Voltage regulator 204 supplies DC power to the anodes 201 of LEDs 110 via conductor or path 242. Voltage regulator 204 is also electrically coupled to cathodes 202 of LEDs 110 via conductor or path 240. Voltage regulator 204 is shown referenced to ground 260 and may be a buck regulator in one example. Controller 108 is shown in electrical communication with voltage regulator 204. In other examples, discrete input generating devices (e.g., switches) may replace controller 108, if desired. Controller 108 includes central processing unit 290 for executing instructions. Controller 108 also includes inputs and outputs (I/O) 288 for operating voltage regulator 204 and other devices. Non-transitory executable instructions may be stored in read only memory 292 (e.g., non-transitory memory) while variables may be stored in random access memory 294. Voltage regulator 204 supplies an adjustable voltage to LEDs 110.

Variable resistor 220 in the form of a field-effect transistor (FET) receives an intensity signal voltage from controller 108 or via another input device. While the present example describes the variable resistor as an FET, one must note that the circuit may employ other forms of variable resistors.

In this example, at least one element of array 20 includes solid-state light-emitting elements such as light-emitting diodes (LEDs) or laser diodes produce light. The elements may be configured as a single array on a substrate, multiple arrays on a substrate, several arrays either single or multiple on several substrates connected together, etc. In one example, the array of light-emitting elements may consist of a Silicon Light Matrix™ (SLM) manufactured by Phoseon Technology, Inc.

The circuit shown in FIG. 2 is a closed loop current control circuit 208. In closed loop circuit 208, the variable resistor 220 receives an intensity voltage control signal via conductor or path 230 through the drive circuit 222. The variable resistor 220 receives its drive signal from the driver 222. Voltage between variable resistor 220 and array 20 is controlled to a desired voltage as determined by voltage regulator 204. The desired voltage value may be supplied by controller 108 or another device, and voltage regulator 204 controls voltage signal 242 to a level that provides the desired voltage in a current path between array 20 and variable resistor 220. Variable resistor 220 controls current flow from array 20 to current sense resistor 255 in the direction of arrow 245. The desired voltage may also be adjusted responsive to the type of lighting device, type of work piece, curing parameters, and various other operating conditions. An electrical current signal may be fed back along conductor or path 236 to controller 108 or another device that adjusts the intensity voltage control signal provided to drive circuit 222 responsive to current feedback provided by path 236. In particular, if the electrical current signal is different from a desired electrical current, the intensity voltage control signal passed via conductor 230 is increased or decreased to adjust electrical current through array 20. A feedback current signal indicative of electrical current flow through array 20 is directed via conductor 236 as a voltage level that changes as electrical current flowing through current sense resistor 255 changes.

In one example where the voltage between variable resistor 220 and array 20 is adjusted to a constant voltage, current flow through array 20 and variable resistor 220 is adjusted via adjusting the resistance of variable resistor 220. Thus, a voltage signal carried along conductor 240 from the variable resistor 220 does not go to the array 20 in this example. Instead, the voltage feedback between array 20 and variable resistor 220 follows conductor 240 and goes to a voltage regulator 204. The voltage regulator 204 then outputs a voltage signal 242 to the array 20. Consequently, voltage regulator 204 adjusts its output voltage in response to a voltage downstream of array 20, and current flow through array 20 is adjusted via variable resistor 220. Controller 108 may include instructions to adjust a resistance value of variable resistor 220 in response to array current fed back as a voltage via conductor 236. Conductor 240 allows electrical communication between the cathodes 202 of LEDs 110, input 299 (e.g., a drain of an N-channel MOSFET) of variable resistor 220, and voltage feedback input 293 of voltage regulator 204. Thus, the cathodes 202 of LEDs 110, an input side 299 of variable resistor 220, and voltage feedback input 293 are at the same voltage potential.

The variable resistor may take the form of an FET, a bipolar transistor, a digital potentiometer or any electrically controllable, current limiting device. The drive circuit may take different forms depending upon the variable resistor used. The closed loop system operates such that an output voltage regulator 204 remains about 0.5 V above a voltage to operate array 20. The regulator output voltage adjusts voltage applied to array 20 and the variable resistor controls current flow through array 20 to a desired level. The present circuit may increase lighting system efficiency and reduce heat generated by the lighting system as compared to other approaches. In the example of FIG. 2, the variable resistor 220 typically produces a voltage drop in the range of 0.6V. However, the voltage drop at variable resistor 220 may be less or greater than 0.6V depending on the variable resistor's design.

Thus, the circuit shown in FIG. 2 provides voltage feedback to a voltage regulator to control the voltage drop across array 20. For example, since operation of array 20 results in a voltage drop across array 20, voltage output by voltage regulator 204 is the desired voltage between array 20 and variable resistor 220 plus the voltage drop across array 220. If the resistance of variable resistor 220 is increased to decrease current flow through array 20, the voltage regulator output is adjusted (e.g., decreased) to maintain the desired voltage between array 20 and variable resistor 20. On the other hand, if the resistance of variable resistor 220 is decreased to increase current flow through array 20, the voltage regulator output is adjusted (e.g., increased) to maintain the desired voltage between array 20 and variable resistor 20. In this way, the voltage across array 20 and current through array 20 may be simultaneously adjusted to provide a desired light intensity output from array 20. In this example, current flow through array 20 is adjusted via a device (e.g., variable resistor 220) located or positioned downstream of array 20 (e.g., in the direction of current flow) and upstream of a ground reference 260.

In this example, array 20 is shown were all LEDs are supplied power together. However, current through different groups of LEDs may be controlled separately via adding additional variable resistors 220 (e.g., one for each array that is supplied controlled current). Controller 108 adjusts current through each variable resistor to control current through multiple arrays similar to array 20.

Referring now to FIG. 3, a schematic of a second lighting system circuit that may be supplied varying amounts of current is shown. FIG. 3 includes some of the same elements as the first lighting system circuit shown in FIG. 2. Elements in FIG. 3 that are the same as elements in FIG. 2 are labeled with the same numeric identifiers. For the sake of brevity, a description of same elements between FIG. 2 and FIG. 3 is omitted; however, the description of elements in FIG. 2 applies to the elements in FIG. 3 that have the same numerical identifiers.

The lighting system shown in FIG. 3 includes a SLM section 301 that includes array 20 which includes LEDs 110. The SLM also includes switch 308 and current sense resistor 255. However, switch 308 and current sense resistor may be included with voltage regulator 304 or as part of controller 108 if desired. Voltage regulator 304 includes voltage divider 310 which is comprised of resistor 313 and resistor 315. Conductor 340 puts voltage divider 310 into electrical communication with cathodes 202 of LEDs 110 and switch 308. Thus, the cathodes 202 of LEDs 110, an input side 305 (e.g., a drain of a N channel MOSFET) of switch 308, and node 321 between resistors 313 and 315 are at a same voltage potential. Switch 308 is operated in only open or closed states, and it does not operate as a variable resistor having a resistance that can be linearly or proportionately adjusted. Further, in one example, switch 308 has a Vds of 0 V as compared to 0.6V Vds for variable resistor 220 shown in FIG. 2.

The lighting system circuit of FIG. 3 also includes an error amplifier 326 receiving a voltage that is indicative of current passing through array 20 via conductor 340 as measured by current sense resistor 255. Error amplifier 326 also receives a reference voltage from controller 108 or another device via conductor 319. Output from error amplifier 326 is supplied to the input of pulse width modulator (PWM) 328. Output from PWM is supplied to buck stage regulator 330, and buck stage regulator 330 adjusts current supplied between a regulated DC power supply (e.g., 102 of FIG. 1) and array 20 from a position upstream of array 20.

In some examples, it may be desirable to adjust current to array via a device located or upstream (e.g., in the direction of current flow) of array 20 instead of a position that is downstream of array 20 as is shown in FIG. 2. In the example lighting system of FIG. 3, a voltage the feedback signal supplied via conductor 340 goes directly to voltage regulator 304. A current demand, which may be in the form of an intensity voltage control signal, is supplied via conductor 319 from controller 108. The signal becomes a reference signal Vref, and it is applied to error amplifier 326 rather than to the drive circuit for a variable resistor.

The voltage regulator 304 directly controls the SLM current from a position upstream of array 20. In particular, resistor divider network 310 causes the buck regulator stage 330 to operate as a traditional buck regulator that monitors the output voltage of buck regulator stage 330 when the SLM is disabled by opening switch 308. The SLM may selectively receive an enable signal from conductor 302 which closes switch 308 and activates the SLM to provide light. Buck regulator stage 330 operates differently when a SLM enable signal is applied to conductor 302. Specifically, unlike more typical buck regulators, the buck regulator controls the load current, the current to the SLM and how much current is pushed through the SLM. In particular, when switch 308 is closed, current through array 20 is determined based on voltage that develops at node 321.

The voltage at node 321 is based on the current flowing through current sense resistor 255 and current flow in voltage divider 310. Thus, the voltage at node 321 is representative of current flowing through array 20. A voltage representing SLM current is compared to a reference voltage provided by controller 108 via conductor 319 that represents a desired current flow through the SLM. If the SLM current is different from the desired SLM current, an error voltage develops at the output of error amplifier 326. The error voltage adjusts a duty cycle of PWM generator 328 and a pulse train from PWM generator 328 controls a charging time and a discharging time of a coil within buck stage 330. The coil charging and discharging timing adjusts an output voltage of voltage regulator 304. Current flow through array 20 may be adjusted via adjusting the voltage output from voltage regulator 304 and supplied to array 20. If additional array current is desired, voltage output from voltage regulator 304 is increased. If reduced array current is desired, voltage output from voltage regulator 304 is decreased.

Thus, the system of FIGS. 1-3 provides for a system for operating one or more light emitting devices, comprising: a voltage regulator including a feedback input, the voltage regulator in electrical communication with the one or more light emitting devices; and a controller including non-transitory instructions to provide a dampened current to the one or more light emitting devices in response to a requested step increase in output of the one or more light emitting devices. The system includes where the dampened current profile is based on a time for the one or more light emitting devices to reach half way to an irradiance output of the one or more light emitting devices at a steady state temperature of the light emitting devices.

The system also includes where the dampened current profile is based on a curvature that specifies a rate that irradiance of the one or more light emitting devices converges to a steady state value. The system includes where the dampened current profile is based on a current when the one or more light emitting devices is at a thermally steady state junction temperature. The system includes additional instructions to adjust a variable resister to provide the dampened current profile, and further comprising additional instructions to amplify current (e.g., increase to a value greater than the selected current $I_{eq}$) to the one or more light emitting devices in response to a requested step decrease in output of the one or more light emitting devices. The system includes additional instructions to output a voltage that corresponds to the dampened current response.

Referring now to FIG. 4, a plot of an example simulated response of a lighting system is shown. The plot of FIG. 4 includes a first Y axis on the left side of the plot and a second Y axis on the right side of the plot. The first Y axis represents normalized irradiance and the second Y axis represents LED junction temperature. The X axis represents time and time increases from the left side of the plot to the right side of the plot. Time begins at time T0 and increases to the rights side of the X axis. The lighting output of the array reaches a steady state value at time T2 when the method of FIG. 5 is not used to control lighting array output.

The plot includes three curves 402-406. Curve 402 represents irradiance of array 20 responsive to a step change in requested lighting array output when lighting array current is controlled according to the method of FIG. 5. Curve 404 represents irradiance of array 20 responsive to a step change in requested lighting array output, the same step change in requested lighting array output as for curve 402, when power is applied to array 20 without current control according to the method of FIG. 5. Finally, curve 406 represents LED junction temperature for array 20 responsive to the same step change in requested lighting array output as for curve 402. The step change in requested lighting array output begins at time T0.

It may be observed that curve 402 closely follows the step change in requested lighting array output. However, curve 404 shows that lighting array irradiance initially overshoots the desired output (e.g., the value of 1) and then decays to the desired output as the LED junction temperature increases. Consequently, the lighting array output may be greater than is desired in response to a request to increase lighting array output when lighting array current is not controlled according to the method of FIG. 5. Thus, if a voltage and/or current are simply increased in response to a request for additional lighting array output, lighting array output may exceed a desired level when the method of FIG. 5 is not employed.

Figure 5:
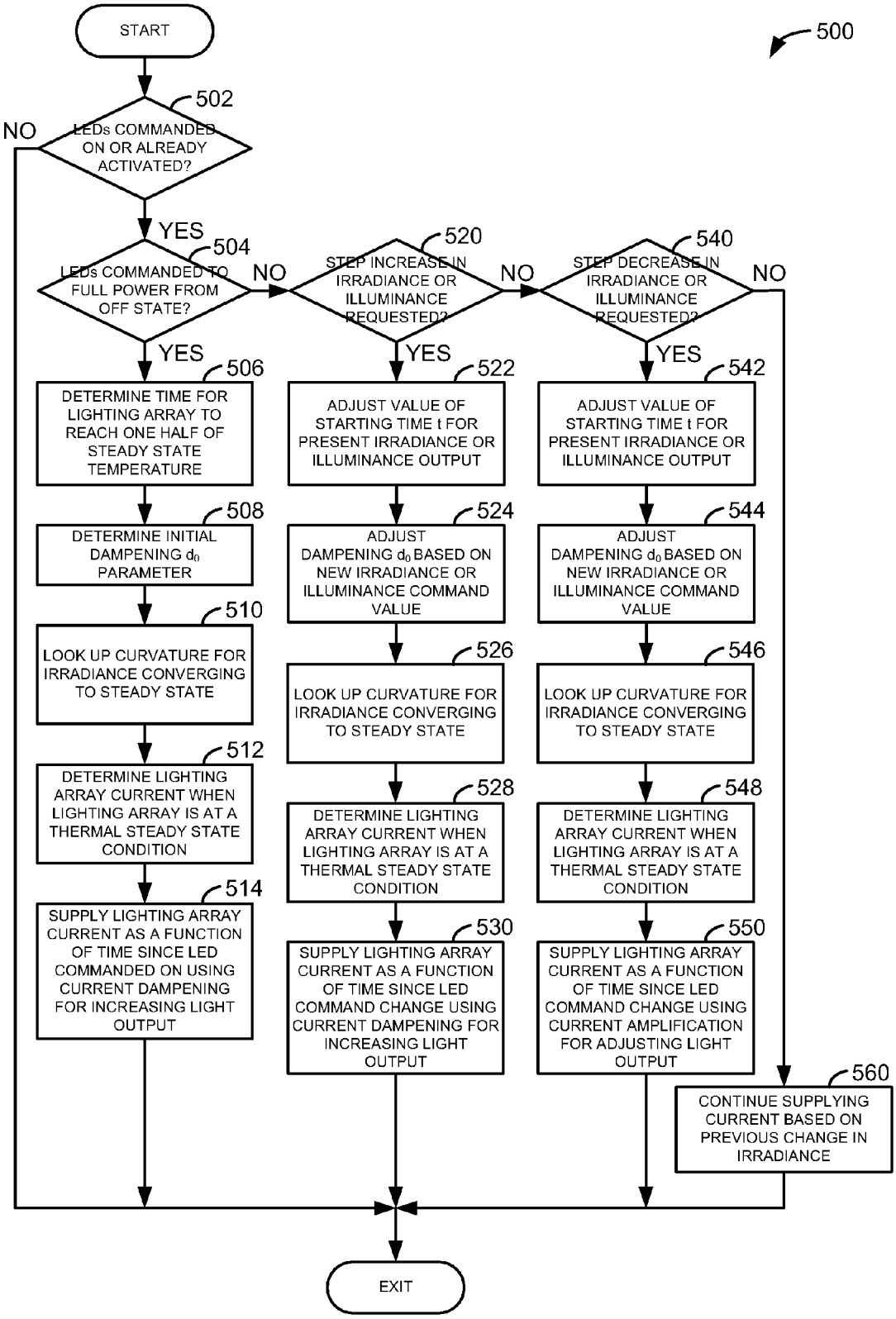
FIG. 5 shows an example method for controlling output of a lighting system.

The time for the lighting array output to reach half way to the steady state temperature lighting irradiance output from the onset of the request to increase lighting array intensity (e.g., T0) when the method of FIG. 5 is not used to control array current is the amount of time between vertical markers T0 and T1. This amount of time may be may be denoted as $t_{1/2max}$. An exponential rate of decay for the lighting array output to reach steady state from the onset of the request to increase lighting array intensity when the method of FIG. 5 is not used to control array current is referred to as the curvature and it may be by the exponential parameter denoted c. The parameter c describes the rate of decay at 420 for curve 404.

Thus, FIG. 4 shows that the method of FIG. 5 allows a more uniform change in light array output in response to a request to increase lighting array output. The method of FIG. 5 provides a near step in irradiance output in response to a step change in desired lighting array output.

Referring now to FIG. 5, a method for controlling output of a lighting system is shown. The method of FIG. 5 may be applied to a system as shown in FIGS. 1-4. The method may be stored as executable instructions in non-transitory memory of a controller. Further, the method of FIG. 5 may operate a lighting array as shown in FIG. 4.

At 502, method 500 judges if LEDs are presently being commanded on or if LEDs are already activated. In one example, method 500 may judge if LEDs are being commanded on or already active in response to a controller input. The controller input may interface with a pushbutton or operator control. The controller input may be at a value of one if the LEDs are being commanded on or if the LEDs are already activated. If method 500 judges that LEDs are being commanded on, or if the LEDs are already on, the answer is yes and method 500 proceeds to 504. Otherwise, the answer is no and method 500 proceeds to exit.

At 504, method 500 judges whether or not LEDs are commanded to full power from an off state. In one example, method 500 judges if the LEDs are commanded to full power based on the irradiance or illuminance requested (e.g., from 0 to 100% power) and a previous value of requested irradiance or illuminance. If the requested irradiance or illuminance changes from zero to one hundred percent, the answer is yes and method 500 proceeds to 506. Otherwise, the answer is no and method 500 proceeds to 520.

At 506, method 500 determines a time for the lighting array to reach one half of the final steady state temperature when the lighting array is operated at full light intensity (e.g., full power). The variable may be denoted as $t_{1/2max}$. In one example, the time is empirically determined and stored to a table or function in memory. Method 500 retrieves the time for the lighting array to reach one half of the final steady state temperature and proceeds to 508.

At 508, method 500 determines an initial dampening of the lighting array irradiance. The dampening parameter may be denoted as $d_0$. The dampening parameter may be empirically determined and stored to memory. The initial dampening may be determined by dividing the initial light output irradiance by the predicted steady state light output irradiance. For example, if the lamp emits 10% higher light output when it is first turned on (relative to steady state), then the eighty percent $d_0$ is given by: $d_0(80\%)=0.8/0.9$ where $d_0(100\%)=0.9$. Method 500 retrieves the dampening parameter and proceeds to 510.

At 510, method 500 looks up the curvature for the lighting array irradiance converging to steady state irradiance at the requested lighting intensity from memory. The curvature may be empirically determined and stored to memory. In one example, the curvature c is experimentally determined via adjusting the c parameter in the equation of step 514 such that the lighting array current causes the lighting array output to approach a step response. The value of c is typically in a range of 1 to 2.5. Method 500 retrieves the curvature value from memory and proceeds to 512.

At 512, method 500 determines lighting array current when the lighting array is supplied full power and operating at a thermal steady state condition. The lighting array current may be empirically determined and stored to memory. Method 500 retrieves the lighting array current at thermal steady state conditions and proceeds to 514.

At 514, method 500 adjusts or supplies current to the lighting array as a function of time since the LEDs were commanded fully on using current dampening for increasing lighting output. In one example, method 500 determines lighting array output from the following equation:

$$I(t) = \frac{\left(\frac{t}{t_{1/2max}}\right)^c + d_0}{\left(\frac{t}{t_{1/2max}}\right)^c + 1} \times I_{eq}$$

Where t is time since the request to increase lighting array intensity output and t starts at zero unless the lighting array is already outputting light, $t_{1/2max}$ is time for the lighting array output to reach half way to the steady state temperature lighting irradiance output from the onset of the request to increase lighting array intensity output, $d_0$ is an initial dampening value, c is a curvature value indicating the rate at which light intensity output converges to the new steady state value requested, $I_{eq}$ is lighting array current at thermal steady state conditions, and I(t) is lighting array current as a function of time. Method 500 outputs a current command based on I(t) after a request to increase lighting array output. In some examples, the current command may be transformed via a transfer function to a voltage that represents a requested lighting array current via a transfer function that describes lighting array current as a function of an output voltage applied to the lighting array current sources described in FIGS. 2 and 3. In this way, method 500 outputs a dampened current profile in response to a step request in lighting array output.

The current $I_{eq}$ is lighting array current at thermal steady state conditions and it may be empirically determined and stored in a table or function that is indexed by desired lighting array output. The desired lighting array output may be specified based on electrical power supplied to the lighting array, irradiance, or illuminance. A step change in the desired lighting array output indexes the table or function and the table or function outputs current $I_{eq}$. Method 500 outputs current to the lighting array and proceeds to exit.

At 520, method 500 judges whether or not a step increase in lighting array irradiance or illuminance is requested. In one example, method 500 judges if the LEDs are commanded to a step increase in output based on the irradiance or illuminance requested (e.g., from 30% to 60% power) and a previous value of requested irradiance or illuminance. If the requested irradiance or illuminance changes positively by more than a threshold amount, the answer is yes and method 500 proceeds to 522. Otherwise, the answer is no and method 500 proceeds to 540.

At 522, method 500 adjusts a starting value of time t for the equation of step 514 based on the lighting array output before the present requested change in lighting array output. For example, if there is a requested change in lighting array output from 50% of full power to 80% of full power $t=2*t_{1/2max}*0.5$. In this way, the starting value of t may be updated to adjust the lighting array commanded current when the lighting array is already outputting light energy. Method 500 adjusts the starting value of time t and proceeds to 524.

At 524, method 500 adjusts the dampening parameter $d_0$ based on the final light intensity requested. In particular, the value of $d_0$ for full lighting array output is adjusted based on the fractional amount of lighting array output requested. For example, if lighting array output is request to be 80% of full irradiance or illuminance, the value of $d_0$ determined at 508 is adjusted as follows: $d_0(80\%)=1-((1-d_0(100\%))*0.8$. In this way, the dampening parameter is adjusted when an increase in lighting array output is requested. Method 500 retrieves the dampening parameter and proceeds to 526.

At 526, method 500 looks up the curvature for the lighting array irradiance converging to steady state irradiance at the requested lighting intensity from memory. The curvature may be empirically determined and stored to memory. The curvature may be determined as described at step 510. Method 500 retrieves the curvature value from memory and proceeds to 528.

At 528, method 500 determines lighting array current when the lighting array is supplied full power and operating at a thermal steady state condition. The lighting array current may be empirically determined and stored to memory. Method 500 retrieves the lighting array current at thermal steady state conditions and proceeds to 530.

At 530, method 500 adjusts or supplies current to the lighting array as a function of time since the LEDs were commanded to a new irradiance or illuminance using current dampening for increasing lighting output. In one example, method 500 determines lighting array output from the equation described in step 514. Method 500 outputs a current command based on I(t) after a request to increase lighting array output. The current command may be transformed via a transfer function to a voltage that represents a requested lighting array current via a transfer function that describes lighting array current as a function of an output voltage applied to the lighting array current sources described in FIGS. 2 and 3. In this way, method 500 outputs a dampened current profile in response to a step request in lighting array output. Method 500 outputs the lighting array current and proceeds to exit.

At 540, method 500 judges whether or not a step decrease in lighting array irradiance or illuminance is requested. In one example, method 500 judges if the LEDs are commanded to a step decrease in output based on the irradiance or illuminance requested (e.g., from 80% to 50% power) and a previous value of requested irradiance or illuminance. If the requested irradiance or illuminance changes negatively by more than a threshold amount, the answer is yes and method 500 proceeds to 542. Otherwise, the answer is no and method 500 proceeds to 560.

At 542, method 500 adjusts a starting value of time t for the equation of step 550 based on the lighting array output before the present requested change in lighting array output. For example, if there is a requested change in lighting array output from 80% of full power to 50% of full power $t=2*t_{1/2max}*0.8$. In this way, the starting value of t may be updated to adjust the lighting array commanded current when the lighting array is already outputting light energy. Method 500 adjusts the starting value of time t and proceeds to 544.

At 544, method 500 adjusts the dampening parameter $d_0$ based on the final light intensity requested. In particular, the value of $d_0$ for full lighting array output is adjusted based on the fractional amount of lighting array output requested. For example, if lighting array output is request to be 50% of full irradiance or illuminance starting from a value of 80%, the value of $d_0$ determined at 508 is adjusted as follows: $d_0(50\%)=1-((1-d_0(100\%))*0.5$. In this way, the dampening parameter is adjusted when a decrease in lighting array output is requested. Method 500 retrieves the dampening parameter and proceeds to 546.

At 546, method 500 looks up the curvature for the lighting array irradiance converging to steady state irradiance at the requested lighting intensity from memory. The curvature may be empirically determined and stored to memory. The curvature may be determined as described at step 510. Method 500 retrieves the curvature value from memory and proceeds to 548.

At 548, method 500 determines lighting array current when the lighting array is supplied full power and operating at a thermal steady state condition. The lighting array current may be empirically determined and stored to memory. Method 500 retrieves the lighting array current at thermal steady state conditions and proceeds to 550.

At 550, method 500 adjusts or supplies current to the lighting array as a function of time since the LEDs were commanded to a new irradiance or illuminance using current amplification for decreasing lighting output. In one example, method 500 determines lighting array output from the following equation:

$$I(t) = \frac{\left(\frac{t}{t_{1/2max}}\right)^c + 1}{\left(\frac{t}{t_{1/2max}}\right)^c + d_0} \times I_{eq}$$

The variables for step 550 are the same variables as described in step 514. Method 500 outputs a current command to control lighting array current based on I(t) after a request to decrease lighting array output is provided. The current command may be transformed via a transfer function to a voltage that represents a requested lighting array current via a transfer function that describes lighting array current as a function of an output voltage applied to the lighting array current sources described in FIGS. 2 and 3. Current $I_{eq}$ is amplified at step 550 to provide current I(t). In other words, drive current I(t) is amplified from $I_{eq}$ (e.g., increased) in response to a decreasing step in requested irradiance. In this way, method 500 outputs an amplified current profile in response to a decreasing step request in lighting array output. Method 500 proceeds to exit after the lighting array current is output.

At 560, method 500 continues to supply current based on the previously requested change in irradiance or illuminance so that current supplied to the lighting array converges to the current at thermal steady state conditions. Thus, the method of FIG. 5 continues to control current supplied to the lighting array via the equation described at 514 or the equation described at 550 depending on the whether the lighting output is increased or decreased in a step-wise manner.

In this way, the method of FIG. 5 provides for a method for operating one or more light emitting devices, comprising: selecting a current that corresponds to a desired irradiance output of the one or more light emitting devices at thermal steady state conditions of the one or more light emitting devices in response to a step change in the desired irradiance output of the one or more light emitting devices; and dampening the current based on one or more irradiance response attributes of the one or more light emitting devices when the one or more light emitting devices respond to the step change in the desired irradiance output without dampening the current; and outputting the dampened current to the one or more light emitting devices. In other words, lighting response attributes determined by supplying a step increase or decrease in voltage or current supplied to the lighting array without dampening or amplifying (e.g., increasing) lighting array current may be subsequently applied to dampen or amplify lighting array current during a later activation of the lighting array.

In some examples, the method includes where the current is dampened based on a time for the one or more light emitting devices to reach one half of a steady state temperature light output corresponding to the current. The method includes where the current is dampened based on a curvature that specifies a rate that irradiance of the one or more light emitting devices converges to a steady state value. The method includes where the current is based on when the one or more light emitting devices is at a thermally steady state junction temperature at the desired irradiance output. The method includes where dampening the current includes adjusting the current according to a first equation in response to the step change in the desired irradiance increasing.

The method also includes where dampening the current includes adjusting the current according to a second equation in response to the step change in the desired irradiance decreasing. The method includes where the dampened current is provided via a variable resistor. The method includes where the dampened current is provided via a buck stage regulator.

The method of FIG. 5 also includes a method for operating one or more light emitting devices, comprising: in response to a step change in requested output of the one or more light emitting devices, adjusting current supplied to the one or more light emitting devices responsive to one or more parameters based on output of the one or more light emitting devices when a step change in voltage or current is applied to the one or more light emitting devices, the step change in voltage or current not occurring at a same time as the step change in the requested output of the one or more light emitting devices. The method includes where the one or more parameters includes a curvature parameter.

In some examples, the method includes where the one or more parameters includes a dampening parameter. The method includes where the step change is an increasing step change. The method includes where the step change is a decreasing step change. The method further comprises adjusting the current supplied to the one or more light emitting devices in response to initial conditions of the one or more light emitting devices, the initial conditions being other than zero.

As will be appreciated by one of ordinary skill in the art, the methods described in FIG. 5 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of the computer readable storage medium in the lighting control system.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A system for operating one or more light emitting devices, comprising:

a voltage regulator including a feedback input, the voltage regulator in electrical communication with the one or more light emitting devices; and a controller including non-transitory instructions to provide a dampened current to the one or more light emitting devices in response to a requested step increase in output of the one or more light emitting devices, and where a dampened current profile is based on a curvature that specifies a rate that irradiance of the one or more light emitting devices converges to a steady state value.

2. The system of claim 1, where the dampened current profile is based on a time for the one or more light emitting devices to reach half way to an irradiance output of the one or more light emitting devices at a steady state temperature of the light emitting devices.

3. The system of claim 1, where the dampened current profile is based on a current when the one or more light emitting devices is at a thermally steady state junction temperature.

4. The system of claim 1, including additional instructions to adjust a variable resistor to provide the dampened current, and further comprising additional instructions to amplify current to the one or more light emitting devices in response to a requested step decrease in output of the one or more light emitting devices.

5. The system of claim 1, including additional instructions to output a voltage that corresponds to the dampened current.

6. A method for operating one or more light emitting devices, comprising:

selecting a current that corresponds to a desired irradiance output of the one or more light emitting devices at thermal steady state conditions of the one or more light emitting devices in response to a step increase in the desired irradiance output of the one or more light emitting devices;

dampening the current based on one or more irradiance response attributes of the one or more light emitting devices when the one or more light emitting devices respond to the step increase in the desired irradiance output without dampening the current; and outputting the dampened current to the one or more light emitting devices.

7. The method of claim 6, where the current is dampened based on a time for the one or more light emitting devices to reach one half of a steady state temperature light output corresponding to the current.

8. The method of claim 6, where the current is dampened based on a curvature that specifies a rate that irradiance of the one or more light emitting devices converges to a steady state value.

9. The method of claim 6, where the current is based on when the one or more light emitting devices is at a thermally steady state junction temperature at the desired irradiance output.

10. The method of claim 6, where dampening the current includes adjusting the current according to a first equation in response to the step change in the desired irradiance increasing.

11. The method of claim 10, where dampening the current includes adjusting the current according to a second equation in response to the step change in the desired irradiance decreasing.

12. The method of claim 6, where the dampened current is provided via a variable resistor.

13. The method of claim 6, where the dampened current is provided via a buck stage regulator.

14. A method for operating one or more light emitting devices, comprising:

in response to a step change in requested output of the one or more light emitting devices, adjusting current supplied to the one or more light emitting devices responsive to one or more parameters based on output of the one or more light emitting devices when a step change in voltage or current is applied to the one or more light emitting devices, the step change in voltage or current not occurring at a same time as the step change in the requested output of the one or more light emitting devices; and adjusting the current supplied to the one or more light emitting devices in response to initial conditions of the one or more light emitting devices, the initial conditions being other than zero.

15. The method of claim 14, where the one or more parameters includes a curvature parameter.

16. The method of claim 14, where the one or more parameters includes a dampening parameter.

17. The method of claim 14, where the step change is an increasing step change.

18. The method of claim 14, where the step change is a decreasing step change.

* * * * *